US009969074B2

(12) United States Patent
Flaherty

(10) Patent No.: US 9,969,074 B2
(45) Date of Patent: May 15, 2018

(54) ADJUSTABLE COMPRESSIBLE TOOL HANDLE

(71) Applicant: Stephen Flaherty, Carp (CA)

(72) Inventor: Stephen Flaherty, Carp (CA)

(73) Assignee: MULTI JUST IMPLEMENTS INC., Carp (CA)

( * ) Notice: Subject to any disclaimer, the term of this patent is extended or adjusted under 35 U.S.C. 154(b) by 434 days.

(21) Appl. No.: 14/659,660

(22) Filed: Mar. 17, 2015

(65) Prior Publication Data

US 2016/0236339 A1 Aug. 18, 2016

(30) Foreign Application Priority Data

Feb. 18, 2015 (CA) ..... 2882150

(51) Int. Cl.
*B25G 1/01* (2006.01)
*B25G 1/04* (2006.01)

(52) U.S. Cl.
CPC ..... *B25G 1/01* (2013.01); *B25G 1/04* (2013.01)

(58) Field of Classification Search
CPC ..... B25G 1/01; B25G 1/04
See application file for complete search history.

(56) References Cited

U.S. PATENT DOCUMENTS 2,996,111 A * 8/1961 Mocerino ..... A01B 1/02 126/401
4,070,932 A * 1/1978 Jeannotte ..... B25G 1/043 16/429
4,691,954 A 9/1987 Shaud
5,690,374 A 11/1997 Jacobs et al.
5,816,634 A 10/1998 Jacobs et al.
5,957,516 A 9/1999 Jacobs et al.
6,145,899 A 11/2000 Kelemen
6,874,201 B2 * 4/2005 Ta ..... B05C 17/0205 16/427
7,118,145 B1 10/2006 Rosine et al.
7,293,361 B1 * 11/2007 Miller ..... E01H 5/02 173/202
7,581,771 B2 9/2009 Rosine et al.
2004/0123470 A1 * 7/2004 Gray ..... A47L 13/022 30/169
2012/0103644 A1 5/2012 Walsh et al.

FOREIGN PATENT DOCUMENTS

GB 2468509 A * 9/2010 ..... A01B 1/026
GB 2472045 A 1/2011
WO WO 9739858 A1 * 10/1997 ..... A01B 1/00
WO WO 2013-150285 A1 10/2013

* cited by examiner

*Primary Examiner* — Monica Carter
*Assistant Examiner* — Lauren Beronja
(74) *Attorney, Agent, or Firm* — Saliwanchik, Lloyd & Eisenschenk

(57) ABSTRACT

A compressible handle for a tool is reversibly compressible along its longitudinal axis during use of the tool. The handle includes a first longitudinal portion and a second longitudinal portion which can slide in opposing directions relative to each other along the longitudinal axis of the handle. The handle further includes a biasing element providing a biasing force to bias the first longitudinal portion and the second longitudinal portion away from each other, and a bias adjustment mechanism by means of which a user can apply and vary a load applied to the biasing element so as to modify the magnitude of the biasing force and thereby adjust the compressibility of the handle.

11 Claims, 6 Drawing Sheets

ADJUSTABLE COMPRESSIBLE TOOL HANDLE

CROSS-REFERENCE TO A RELATED APPLICATION

This application claims priority to Canadian Patent Application No. 2,882,150, filed Feb. 18, 2015, which is incorporated herein by reference in its entirety.

BACKGROUND

The present invention relates to a compressible handle for a tool. More specifically, the present invention relates to an adjustable shock absorbing handle for tools, the use of which can cause impact to the user.

The use of tools such as shovels, scrapers and garden tools can cause pain or injury to the user due to impact as the tool is pushed repeatedly against a surface or into the ground or other resistant material. It is known to use compressible tool handles which contain a spring or other mechanism to absorb at least some of the shock to a user of such tools. Patent documents GB 2468509, GB 2472045, U.S. Pat. No. 4,691,954, U.S. Pat. No. 5,816,634, U.S. Pat. No. 7,118,145, US 2004/0123470, US 2012/0103644 and WO 2013/150285 describe such tool handles.

In addition, it is desirable to use tool handles which can be attached to a number of different tool heads or handgrips, since this avoids the need for purchasing and storing a number of different tools, each with its own attached handle. However, the amount of shock absorption needed by a user depends upon the type of tool used and the conditions under which it is used. Thus, a person wishing to use a shock-absorbing handle for use with different tool heads is unlikely to find a single handle which will absorb shock adequately for all applications. For high impact activities such as scraping ice, removing shingles or floor tiles, or shoveling hard or rocky earth, a handle may be desired which is less compressible, and which allows the worker to use most of the force applied to the handle of the tool to do work, while retaining some shock absorbing ability to protect the worker. On the other hand, a more compressible handle may be more comfortable to use when shoveling light snow or loose dirt, where application of a large force is not usually necessary and where a higher degree of shock absorption can be desirable to cushion a sudden unexpected impact; for example, if the tool should hit a rock or the edge of a curb.

Therefore, there is a need for a shock absorbing, compressible tool handle which has an adjustable compressibility, so as to be useful for tasks where different levels of shock absorption are needed.

SUMMARY

One aspect of the present invention provides a tool handle which is reversibly compressible along its longitudinal axis during use of the tool. The handle includes a first longitudinal portion and a second longitudinal portion slidably attached to the first longitudinal portion, such that the first longitudinal portion and the second longitudinal portion can slide in opposing directions relative to each other along the longitudinal axis of the handle. The handle further includes a biasing element providing a biasing force to bias the first longitudinal portion and the second longitudinal portion away from each other into mutual distance. When a user applies a compressive force to the handle which opposes and overcomes the biasing force, the first longitudinal portion and the second longitudinal portion are slid towards each other along the longitudinal axis into mutual approach, against the biasing force. The handle also includes a bias adjustment mechanism which can be operated by a user, while the handle remains intact, to apply a variable load to the biasing element, and to vary the variable load applied to the biasing element, thereby allowing the user to modify the magnitude of the biasing force of the biasing element.

In at least one embodiment, the biasing element is a compression spring with an axis of compression aligned with the longitudinal axis of the handle. In at least one such embodiment, the bias adjustment mechanism has a first stop engaging the first longitudinal portion of the handle and abutting the first end of the spring, and a second stop fixed to the second longitudinal portion and abutting the second end of the spring, so as to apply the variable load to the spring. In at least one embodiment, the bias adjustment mechanism can be operated by a user, while the handle remains intact, to advance or retract the first stop with respect to the first longitudinal portion along the longitudinal axis of the handle, so as to vary the variable load on the spring and modify the magnitude of the biasing force. In at least one embodiment the first stop threadedly engages the first longitudinal portion.

In at least one embodiment, the present invention provides a handle for a tool, wherein the handle is reversibly compressible along a longitudinal axis thereof during use of the tool, the handle comprising:

a first longitudinal portion;

a second longitudinal portion slidably attached to the first longitudinal portion, the first longitudinal portion and the second longitudinal portion being mutually slidable in opposing directions along the longitudinal axis of the handle;

a compression spring comprising a first end and a second end and defining an axis of compression aligned with the longitudinal axis of the handle, the compression spring providing a biasing force to bias the first longitudinal portion and the second longitudinal portion into mutual distance, the biasing force having a magnitude, wherein application to the handle of a compressive force opposing and overcoming the biasing force is operable to slide the first longitudinal portion and the second longitudinal portion into mutual approach along the longitudinal axis; and a bias adjustment mechanism comprising a first stop engaging the first longitudinal portion and abutting the first end of the compression spring, and a second stop fixed to the second longitudinal portion and abutting the second end of the compression spring, wherein the bias adjustment mechanism is operable while the handle remains intact to apply a variable load to the compression spring and to vary the variable load so as to modify the magnitude of the biasing force.

In at least one embodiment, the bias adjustment mechanism can include a releasable lock which can prevent modification of the magnitude of the biasing force of the biasing element. In at least one embodiment, the releasable lock can restrict the advancement or retraction of the first stop.

Another aspect of the present invention provides a tool comprising a handle as described herein, a handgrip and a tool head.

Yet another aspect of the present invention provides a kit for assembly of a tool, the kit comprising a handle as described herein, one or more handgrips which can be attached to a first end of the handle and one or more tool heads which can be attached to a second end of the handle.

BRIEF DESCRIPTION OF THE DRAWINGS

Further features of the present invention will become apparent from the following written description and the accompanying figures, in which.

DETAILED DESCRIPTION

Figure 1:
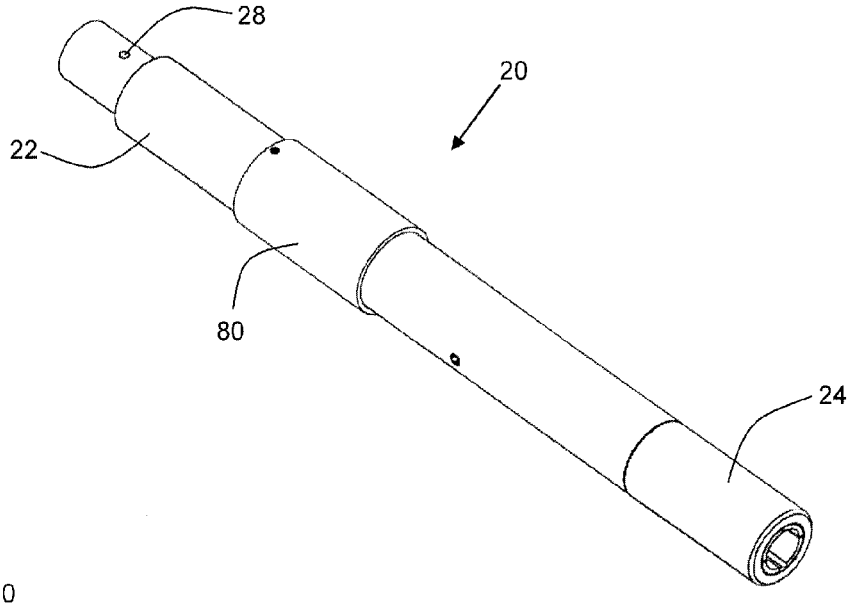
FIG. 1 is a perspective view of an embodiment of an adjustable compressible tool handle according to the present invention.

The present invention provides a compressible tool handle having an adjustable compressibility. The tool handle is configured for use with a tool whose use can cause impact to the user, including but not limited to shovels, scraping tools such as ice scrapers and scrapers used to remove building materials such as shingles and flooring, chopping tools such as ice choppers, and garden tools such as spades, forks, hoes, rakes, trowels, weed removers, and the like. In at least one embodiment, the compressibility of the present tool handle can be adjusted for use of the tool under varying conditions of impact or expected impact.

The handle can be made from any material which provides the required mechanical properties and strength, as will be understood in the art. For example, in at least one embodiment, the handle can be made from metal, plastic, or a composite material.

The handle includes a first longitudinal portion and a second longitudinal portion slidably attached to the first longitudinal portion, such that the first longitudinal portion and the second longitudinal portion can slide in opposing directions relative to each other along the longitudinal axis of the handle. The handle further includes a biasing element providing a biasing force to bias the first longitudinal portion and the second longitudinal portion away from each other into mutual distance.

During use of the tool, a user can apply a compressive force to the handle, to force a tool head attached to the handle against a surface or into a resistant material, for example. When this compressive force opposes and overcomes the biasing force, the first longitudinal portion and the second longitudinal portion slide towards each other along the longitudinal axis, against the biasing force of the biasing element, and the handle compresses, partially absorbing the compressive force. In this way, the handle can provide a cushioning or shock absorbing effect which can reduce the effect of impacts on the body of the user during use of the tool.

The present handle also includes a bias adjustment mechanism allowing the user to vary the load on the biasing element so as to modify the magnitude of the biasing force, without the need to disassemble the handle. By modifying the biasing force of the biasing element, the user can adjust the magnitude of the compressive force which must be applied in order to overcome this biasing force and cause the first and second longitudinal portions to slide towards each other, absorbing at least some of the compressive force. Thus, the bias adjustment mechanism allows adjustment of the compressibility of the handle so that the level of shock absorption is comfortable or appropriate for the desired use of the tool.

For example, if the use of the tool is likely to cause a significant or unexpected impact, the user can reduce the load on the biasing element, thereby reducing the biasing force and making the handle more "springy" or compressible. In this case, the handle is more readily compressed upon application of a lower compressive force and absorbs more of the compressive force applied as the tool is used, to provide a greater cushioning or shock absorbing effect. Alternatively, the user can increase the load on the biasing element, thereby increasing the biasing force so that the handle is stiffer and less readily compressed, and would provide a shock absorbing effect only in the case of a significant impact. In this case, more of the compressive force applied by the user could be used to do work with the tool, and the handle would compress and cushion the user against impact only upon application of a high compressive force.

In at least one embodiment, the biasing element is a compression spring having a first end and a second end and defining an axis of compression aligned with the longitudinal axis of the handle. In such embodiments, the bias adjustment mechanism can modify a variable load on the spring, so as to adjust the biasing force and the compressibility of the spring.

In at least one embodiment, the bias adjustment mechanism includes a first stop which abuts the first end of the spring. The first stop engages the first longitudinal portion of the handle, so that the first stop can be advanced and retracted with respect to the first longitudinal portion along the longitudinal axis of the handle. For example, in at least one embodiment, the first stop includes a thread which engages a mating thread in the first longitudinal portion. The bias adjustment mechanism further includes a second stop which is fixed to the second longitudinal portion of the handle and which abuts the second end of the spring, so that the spring can be compressed between the first stop and the second stop as the first longitudinal portion and second longitudinal portion slide toward each other.

In such embodiments, advancing the first stop with respect to the first longitudinal portion along the longitudinal axis of the handle increases the load on the spring, thereby shortening and compressing the spring. Thus, the biasing force of the spring is increased, and its compressibility is reduced. In addition, retracting the first stop with respect to the first longitudinal portion along the longitudinal axis of the handle decreases the load on the spring, thereby lengthening and decompressing the spring. Thus, the biasing force of the spring is decreased, and its compressibility is increased.

In at least one embodiment, the bias adjustment mechanism further comprises a releasable lock which can limit the advancement or retraction of the first stop. In this way, the compressibility of the tool handle can be adjusted to a desired level, and maintained at that level during further use of the tool while avoiding accidental or unintended adjustment. For example, when the first stop is threaded and engages a mating thread in the first longitudinal portion, the releasable lock can prevent rotation of the first stop with respect to the first longitudinal portion, so as to prevent advancement or retraction of the thread of the first stop along the thread of the first longitudinal portion.

In another aspect, the present invention provides a tool comprising the present handle, a handgrip attached to a first end of the handle, and a tool head attached to a second end of the handle. As will be understood in the art, the handgrip can be of a design and material suitable for the intended use of the tool, and can be permanently or removably attached to the first end of the handle. In addition, the tool head can also be of a design and material suitable for the intended use of the tool, and can be permanently or removably attached to the second end of the handle. Thus, a handle according to the present invention can be adapted for attachment to a number of different handgrips or tool heads. Therefore, in a further aspect, the present invention provides a kit for assembly of a tool, the kit comprising a handle as described herein, one or more handgrips which can be removably attached to a first end of the handle and one or more tool heads which can be removably attached to a second end of the handle.

Figure 2:
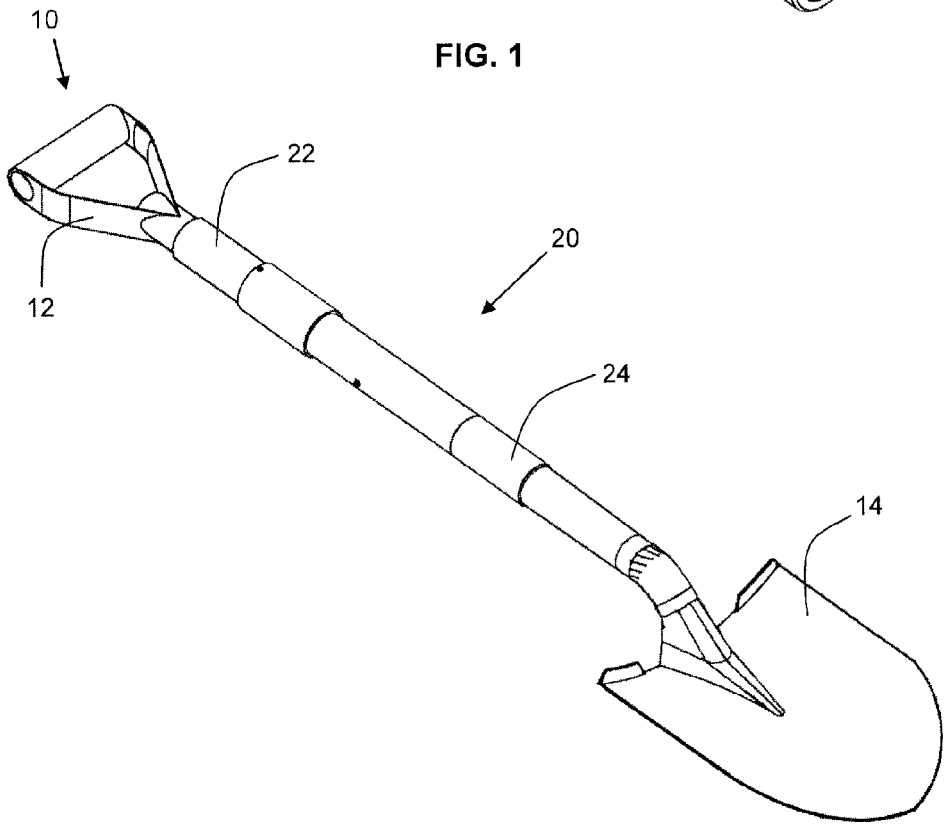
FIG. 2 is a perspective view of a tool including the embodiment of FIG. 1.
Figure 4:
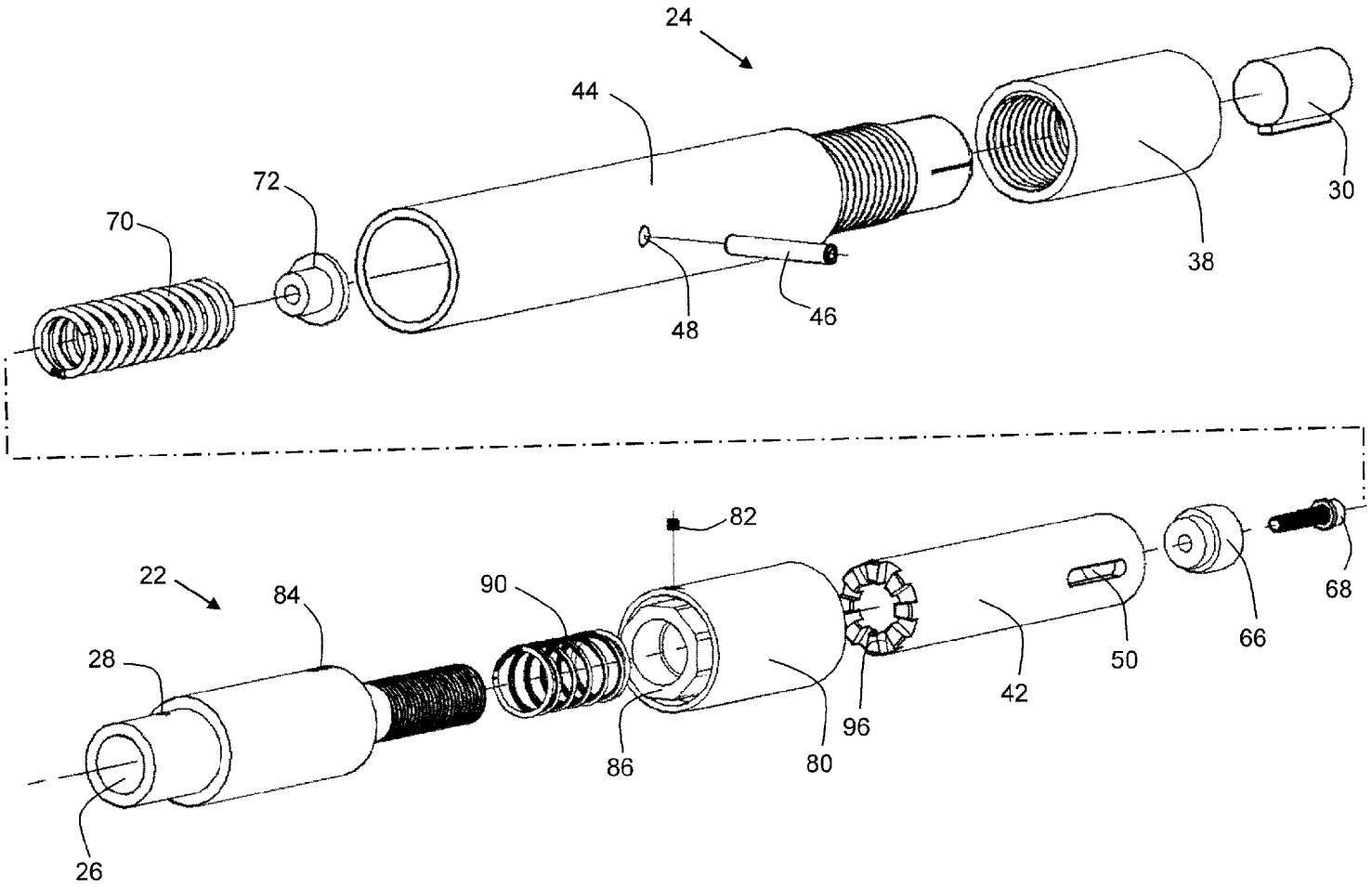
FIG. 4 is an exploded upper perspective view of the embodiment of FIG. 1.
Figure 5:
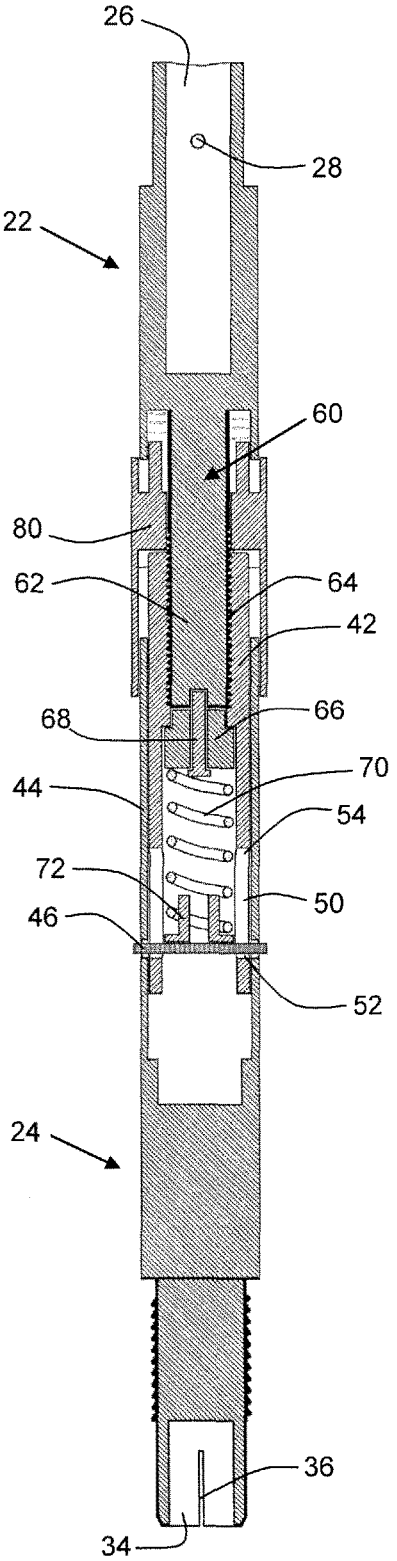
FIG. 5 is a cross-sectional front view of the embodiment of FIG. 1 in an expanded state adjusted for increased compressibility.

Specific embodiments of the present handle will now be described with reference to the Figures. With reference to FIGS. 1 and 2, in at least one embodiment, a tool 10 includes handle 20, whose upper portion 22 is attached to handgrip 12. As seen in FIGS. 1, 4 and 5, in at least one embodiment, handgrip 12 can be received in cavity 26 and held in place by means of a pin or bolt (not shown) passing through handgrip 12 and opening 28 in upper portion 22. In at least one embodiment, handgrip 12 is detachable from and reattachable to handle upper portion 22 by a user by mechanisms well known in the art, so that different handgrips can be used with handle 20 depending on the desired use of the tool, as will be understood by one skilled in the art.

Figure 3:
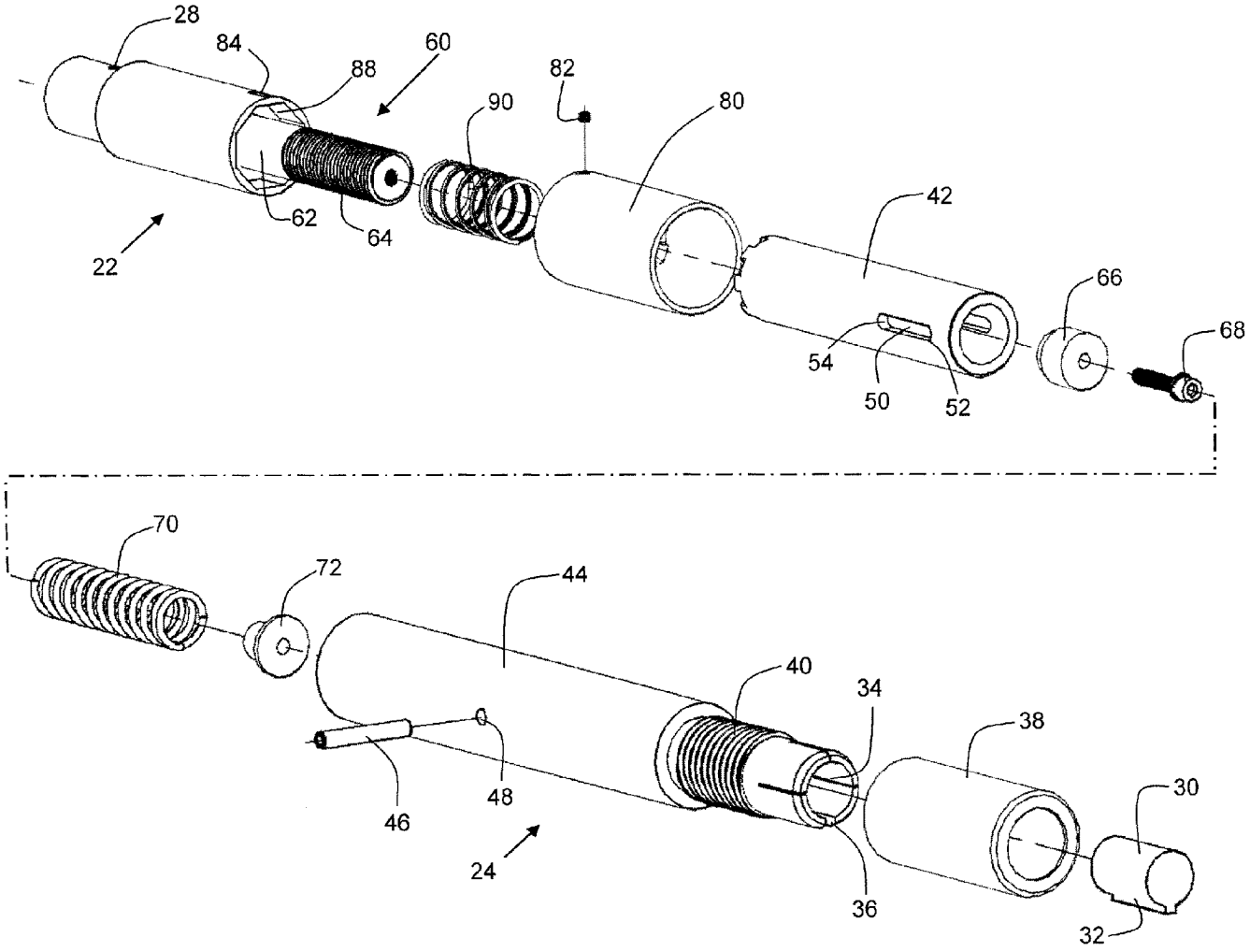
FIG. 3 is an exploded lower perspective view of the embodiment of FIG. 1.

Similarly, in at least one embodiment, lower portion 24 of handle 20 is attached to tool head 14 in tool 10. In at least one embodiment, best seen in FIG. 3, tool head 14 can include tool head stem 30, including ridge 32. Tool head stem 30 is received in cavity 34 of handle lower portion 24 such that ridge 32 is received in slot 36, preventing rotation of tool head 14 during use. Threaded collar 38 engages mating thread 40 on handle lower portion 24, thereby securing tool head stem 30 in place within cavity 34 and securing tool head 14 to handle lower portion 24. In at least one embodiment, tool head 14 is readily detachable from and reattachable to handle lower portion 24 by a user by mechanisms well known in the art, so that different tool heads can be used with handle 20 depending on the desired use of the tool.

The upper portion 22 and lower portion 24 of handle 20 are slidable in opposite directions with respect to each other, as explained below with reference to FIGS. 3 to 6. Upper portion 22 includes inner cylinder 42, and lower portion 24 includes outer cylinder 44, which slidingly receives inner cylinder 42. Lock pin 46 passes through aperture 48 in outer cylinder 44 and slot 50 in inner cylinder 42, attaching outer cylinder 44 to inner cylinder 42. Outer cylinder 44 can therefore slide relative to inner cylinder 42, as pin 46 passes along the length of slot 50 between lower end 52 and upper end 54. However, outer cylinder 44 cannot rotate without also rotating inner cylinder 42. In this way, upper portion 22 and lower portion 24 are mutually attached but can slide relative to each other.

Upper portion 22 also includes an upper stop 60, including threaded stop member 62 having a thread 64 which engages a corresponding thread (not shown) inside inner cylinder 42. In at least one embodiment, threaded stop member 62 is attached to end stop 66 by means of fastener 68, which can be a bolt, screw, or any other fastener known in the art. In one or more alternative embodiments, threaded stop member 62 can be adhered to or unitarily formed with end stop 66 to form upper stop 60, as will be understood by the skilled person.

Figure 6:
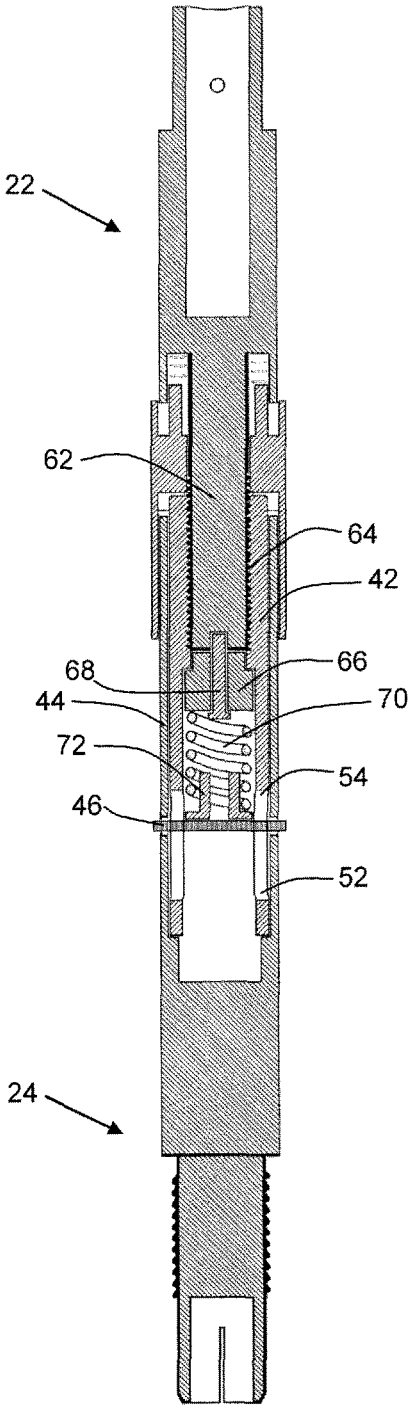
FIG. 6 is a cross-sectional front view of the embodiment of FIG. 5 in a compressed state.

A compression spring 70 having an end cap 72 abuts and is compressed between upper stop 60 and lock pin 46, thus biasing upper portion 22 away from lower portion 24, such that lock pin 46 is forced towards lower end 52 of slot 50. Applying a compressive force to handle 20, as, for example, when tool head 14 of tool 10 is pushed against a surface or into a resistant material, compresses spring 70 and slides inner cylinder 42 further into outer cylinder 44, allowing lock pin 46 to travel towards upper end 54 of slot 50 and moving upper portion 22 and lower portion 24 towards each other, as best seen in FIG. 6. When the compressive force is discontinued, the biasing force of spring 70 forces upper portion 22 and lower portion 24 away from each other until lock pin 46 again rests against lower end 52 of slot 50, as seen in FIG. 5.

Figure 9:
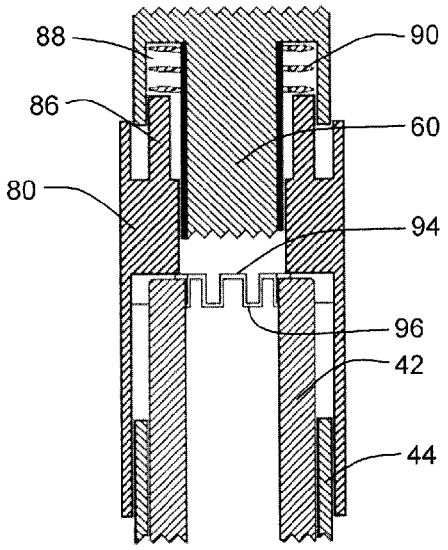
FIG. 9 is a partial cross-sectional front view of the embodiment of FIG. 1 showing the locking collar engaging the inner cylinder.
Figure 10:
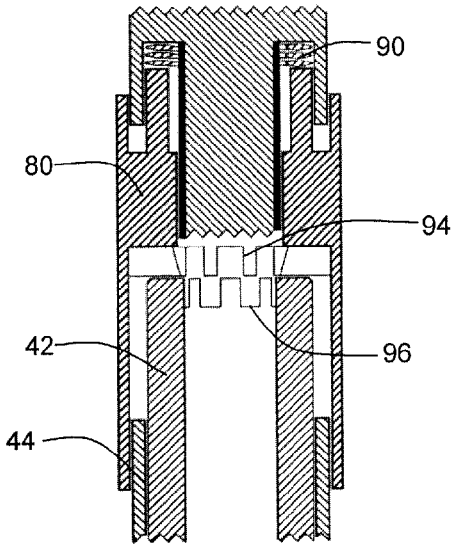
FIG. 10 is a partial cross-sectional front view of the embodiment of FIG. 9 showing the locking collar retracted to disengage from the inner cylinder.
Figure 11:
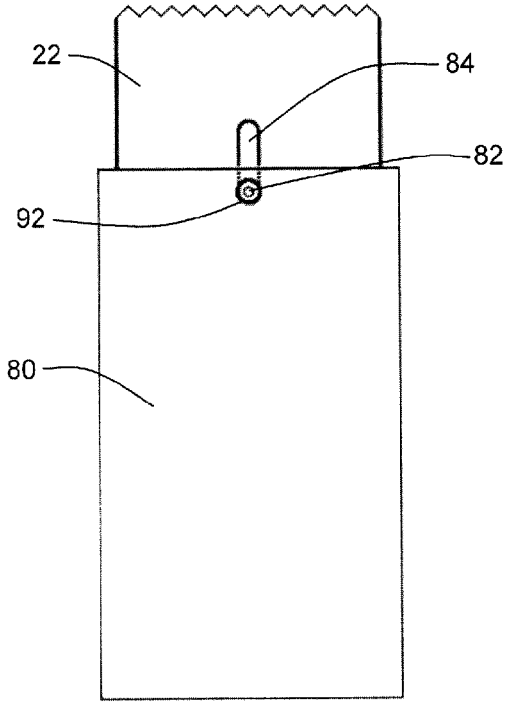
FIG. 11 is a partial front view of the embodiment of FIG. 1 showing the upper portion and locking collar.

With reference to FIGS. 3, 4 and 9 to 11, handle 20 also includes locking collar 80 which is slidably mounted onto upper portion 22 by means of screw 82 which slidably engages slot 84, as best seen in FIG. 11. Locking collar 80 includes a sleeve 86 which engages a mating cavity 88 in upper portion 22. Sleeve 86 and mating cavity 88 can have a polygonal shape or any other shape which restricts rotation of locking collar 80 with respect to upper portion 22, as will be understood in the art. Compression spring 90 received in cavity 88 biases locking collar 80 out of cavity 88 such that screw 82 is forced towards lower end 92 of slot 84.

As best seen in FIG. 9, locking collar 80 also receives outer cylinder 44, inner cylinder 42 and upper stop 60 (cut away in FIGS. 9 and 10) which is threadedly received in inner cylinder 42. Locking collar 80 includes toothed surface 94 which engages mating toothed surface 96 of inner cylinder 42 under the bias of spring 90, thereby preventing rotation of inner cylinder 42 with respect to locking collar 80. As discussed above, the interaction between sleeve 86 and mating cavity 88 prevents locking collar 80 from rotating with respect to upper portion 22 and upper stop 60. Thus, when toothed surface 94 of locking collar 80 engages mating toothed surface 96 of inner cylinder 42, upper portion 22, including upper stop 60, and inner cylinder 42 are prevented from rotating with respect to each other.

In use, to adjust the compressibility of the handle 20, locking collar 80 is slid towards upper portion 22 against the bias of spring 90, thereby sliding screw 82 within slot 84 away from lower end 92, compressing spring 90 and disengaging toothed surface 94 from mating toothed surface 96 of inner cylinder 42, as best seen in FIG. 10. While the locking collar 80 is retained in this position, outer cylinder 44 can be grasped by the user and rotated. Inner cylinder 42 is prevented from rotating with respect to outer cylinder 44 and lower portion 24 by the passage of locking pin 46 through apertures 48 in outer cylinder 44 and slots 50 in inner cylinder 42. Therefore, rotation of outer cylinder 44 also acts to rotate inner cylinder 42. As inner cylinder 42 is rotated, its thread translates longitudinally along the mating thread 64 of threaded stop member 62, thereby advancing or retracting upper stop 60 with respect to inner cylinder 42.

Figure 7:
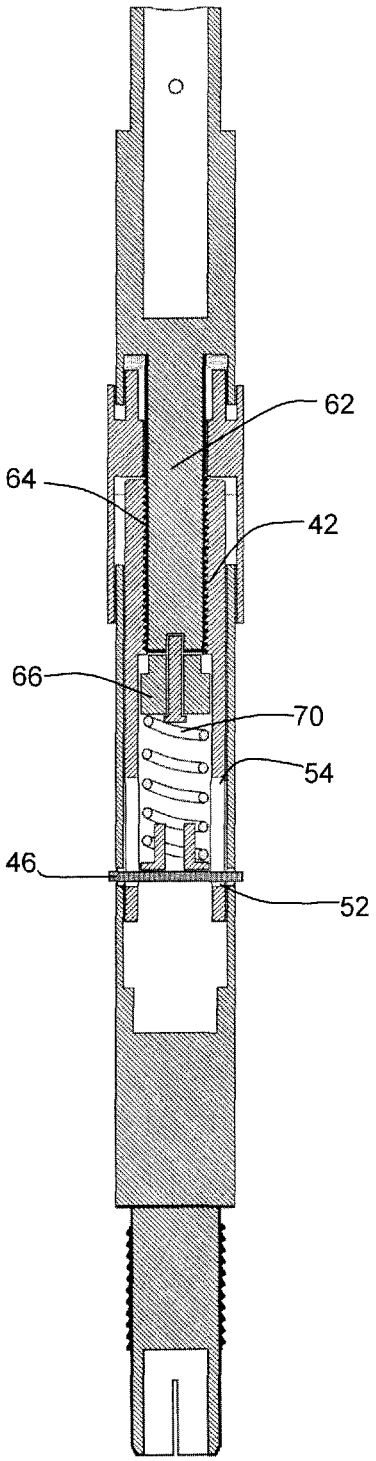
FIG. 7 is a cross-sectional front view of the embodiment of FIG. 1 in an expanded state adjusted for decreased compressibility.
Figure 8:
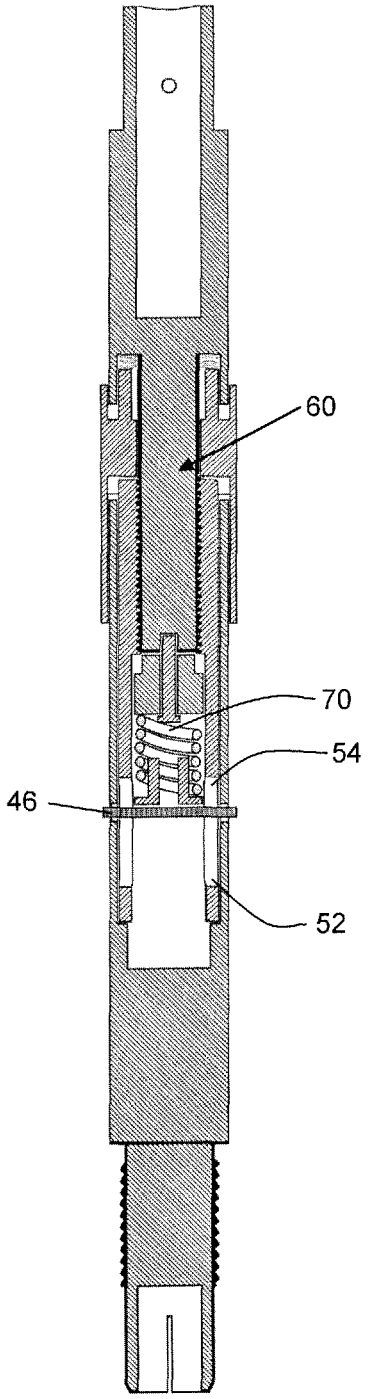
FIG. 8 is a cross-sectional front view of the embodiment of FIG. 7 in a compressed state.

As best seen in FIGS. 7 and 8, advancing upper stop 60 pushes end stop 66 against compression spring 70, so as to compress compression spring 70 against lock pin 46. This compression increases the load on compression spring 70, increasing its biasing force and resistance to further compression and reducing its compressibility in response to a compressive force applied to handle 20, as seen in FIG. 8. Similarly, retracting upper stop 60 decreases the load on compression spring 70, allowing compression spring 70 to expand between end stop 66 and lock pin 46. This expansion decreases the biasing force and resistance to compression of compression spring 70, and increases its compressibility, as seen in FIGS. 5 and 6.

Once the compressibility of compression spring 70 has been adjusted to a desired level, locking collar 80 can be released by the user and its toothed surface 94 will again engage mating toothed surface 96 of inner cylinder 42 under the bias of compression spring 90, preventing further rotation of inner cylinder 42 with respect to upper stop 60 and maintaining the load on compression spring 70 at a substantially constant level in the absence of application of further compressive force. Thus the compressibility of the present handle is readily adjustable by a normal user of the handle while allowing the handle to remain intact and without requiring disassembly of the handle or the tool.

The embodiments described herein are intended to be illustrative of the present compositions and methods and are not intended to limit the scope of the present invention. Various modifications and changes consistent with the description as a whole and which are readily apparent to the person of skill in the art are intended to be included. Terms indicating relative position, such as "upper", "lower", and the like, are intended to indicate relative orientation or position in normal use, and do not limit the scope of the present invention to such orientations or positions. The appended claims should not be limited by the specific embodiments set forth in the examples, but should be given the broadest interpretation consistent with the description as a whole.

The invention claimed is:

1. A handle for a tool, wherein the handle is reversibly compressible along a longitudinal axis thereof during use of the tool, the handle comprising:

a first longitudinal portion;

a second longitudinal portion slidably attached to the first longitudinal portion, the first longitudinal portion and the second longitudinal portion being mutually slidable in opposing directions along the longitudinal axis of the handle;

a biasing element providing a biasing force to bias the first longitudinal portion and the second longitudinal portion into mutual distance, the biasing force having a magnitude, wherein application to the handle of a compressive force opposing and overcoming the biasing force is operable to slide the first longitudinal portion and the second longitudinal portion into mutual approach along the longitudinal axis, wherein the biasing element is a compression spring comprising a first end and a second end and defining an axis of compression aligned with the longitudinal axis of the handle; and a bias adjustment mechanism operable by a user while the handle remains intact to apply a variable load to the biasing element and to incrementally vary the variable load, thereby to incrementally modify the magnitude of the biasing force, wherein the bias adjustment mechanism comprises a first stop engaging the first longitudinal portion and abutting the first end of the spring, and a second stop fixed to the second longitudinal portion and abutting the second end of the spring, wherein the bias adjustment mechanism is operable to incrementally advance or retract the first stop with respect to the first longitudinal portion along the longitudinal axis of the handle, thereby to apply a variable load to the spring and to incrementally vary the variable load on the spring;

wherein the bias adjustment mechanism further comprises a releasable lock operable to restrict advancement or retraction of the first stop, thereby to prevent modification of the magnitude of the biasing force.

2. The handle according to claim 1, wherein the first stop threadedly engages the first longitudinal portion, such that rotating the first longitudinal portion with respect to the first stop incrementally advances or retracts the first stop with respect to the first longitudinal portion along the longitudinal axis of the handle.

3. A handle for a tool, wherein the handle is reversibly compressible along a longitudinal axis thereof during use of the tool, the handle comprising:

a first longitudinal portion;

a second longitudinal portion slidably attached to the first longitudinal portion, the first longitudinal portion and the second longitudinal portion being mutually slidable in opposing directions along the longitudinal axis of the handle;

a compression spring comprising a first end and a second end and defining an axis of compression aligned with the longitudinal axis of the handle, the compression spring providing a biasing force to bias the first longitudinal portion and the second longitudinal portion into mutual distance, the biasing force having a magnitude, wherein application to the handle of a compressive force opposing and overcoming the biasing force is operable to slide the first longitudinal portion and the second longitudinal portion into mutual approach along the longitudinal axis; and a bias adjustment mechanism comprising a first stop engaging the first longitudinal portion and abutting the first end of the compression spring, and a second stop fixed to the second longitudinal portion and abutting the second end of the compression spring, wherein the bias adjustment mechanism is operable while the handle remains intact to apply a variable load to the compression spring, and to incrementally vary the variable load, thereby to incrementally modify the magnitude of the biasing force;

wherein the bias adjustment mechanism is operable to incrementally advance or retract the first stop with respect to the first longitudinal portion along the longitudinal axis of the handle, thereby to incrementally vary the variable load on the spring; and wherein the bias adjustment mechanism further comprises a releasable lock operable to restrict advancement or retraction of the first stop.

4. The handle according to claim 3, wherein the first stop threadedly engages the first longitudinal portion, such that rotating the first longitudinal portion with respect to the first stop incrementally advances or retracts the first stop with respect to the first longitudinal portion along the longitudinal axis of the handle.

5. A tool comprising a handle according to claim 1, a handgrip and a tool head.

6. A kit for assembly of a tool, the kit comprising a handle according to claim 1, one or more handgrips attachable to a first end of the handle and one or more tool heads attachable to a second end of the handle.

7. A tool comprising a handle according to claim 3, a handgrip and a tool head.

8. A kit for assembly of a tool, the kit comprising a handle according to claim 3, one or more handgrips attachable to a first end of the handle and one or more tool heads attachable to a second end of the handle.

9. A handle for a tool, wherein the handle is reversibly compressible along a longitudinal axis thereof during use of the tool, the handle comprising:

a first longitudinal portion;

a second longitudinal portion slidably attached to the first longitudinal portion, the first longitudinal portion and the second longitudinal portion being mutually slidable in opposing directions along the longitudinal axis of the handle;

a biasing element providing a biasing force to bias the first longitudinal portion and the second longitudinal portion into mutual distance, the biasing force having a magnitude, wherein application to the handle of a compressive force opposing and overcoming the biasing force is operable to slide the first longitudinal portion and the second longitudinal portion into mutual approach along the longitudinal axis, wherein the biasing element is a compression spring comprising a first end and a second end and defining an axis of compression aligned with the longitudinal axis of the handle; and a bias adjustment mechanism operable by a user while the handle remains intact to apply a variable load to the biasing element and to incrementally vary the variable load, thereby to incrementally modify the magnitude of the biasing force, wherein the bias adjustment mechanism comprises a first stop engaging the first longitudinal portion and abutting the first end of the spring, and a second stop fixed to the second longitudinal portion and abutting the second end of the spring, wherein the bias adjustment mechanism is operable to incrementally advance or retract the first stop with respect to the first longitudinal portion along the longitudinal axis of the handle, thereby to apply a variable load to the spring and to incrementally vary the variable load on the spring;

wherein the first stop threadedly engages the first longitudinal portion, such that rotating the first longitudinal portion with respect to the first stop incrementally advances or retracts the first stop with respect to the first longitudinal portion along the longitudinal axis of the handle.

10. A tool comprising a handle according to claim 9, further comprising a handgrip and a tool head.

11. A kit for assembly of a tool, the kit comprising:

a handle, according to claim 9, one or more handgrips attachable to a first end of the handle, and one or more tool heads attachable to a second end of the handle.

* * * * *